US005758894A

United States Patent [19]

Maggiolo

[11] Patent Number: 5,758,894

[45] Date of Patent: Jun. 2, 1998

[54] DEVICE FOR IMPROVING THE EFFICIENCY AND CONTROLLABILITY OF SKIS

[76] Inventor: Marco Maggiolo, Via Roncegno 1, 30030 Chirignago (Prov. of Venezia), Italy

[21] Appl. No.: 605,164

[22] PCT Filed: Sep. 8, 1994

[86] PCT No.: PCT/EP94/03015

§ 371 Date: Mar. 6, 1996

§ 102(e) Date: Mar. 6, 1996

[87] PCT Pub. No.: WO95/07737

PCT Pub. Date: Mar. 23, 1995

[30] Foreign Application Priority Data

Sep. 13, 1993 [IT] Italy ..... PD93A0180
Nov. 17, 1993 [IT] Italy ..... PD93A0227

[51] Int. Cl.[6] ..... A63C 5/00

[52] U.S. Cl. ..... 280/602; 280/607; 280/618

[58] Field of Search ..... 280/602, 607, 280/617, 618, 616, 633, 634

[56] References Cited

U.S. PATENT DOCUMENTS

| | | | |
|---|---|---|---|
| 5,211,418 | 5/1993 | Scherübl | 280/607 |
| 5,332,252 | 7/1994 | Le Masson et al. | 280/607 |
| 5,393,086 | 2/1995 | Le Masson et al. | 280/602 |
| 5,413,371 | 5/1995 | Trimble | 280/607 |

FOREIGN PATENT DOCUMENTS

| | | |
|---|---|---|
| 0510308 | 10/1992 | European Pat. Off. . |
| 2626485 | 8/1989 | France . |
| 2654635 | 5/1991 | France . |
| 2246668 | 4/1974 | Germany . |

*Primary Examiner*—Richard M. Camby
*Attorney, Agent, or Firm*—Guido Modiano; Albert Josif

[57] ABSTRACT

The device for improving the efficiency and controllability of skis has two elongated shaped plate-like elements, each having one end provided with locking members for fixing to the ski and another end provided with retention members which allow the other end to slide longitudinally with respect to the ski. A toe unit or heel unit of a ski binding is fixed proximate to one of the ends.

20 Claims, 3 Drawing Sheets

DEVICE FOR IMPROVING THE EFFICIENCY AND CONTROLLABILITY OF SKIS

TECHNICAL FIELD

The present invention relates to a device for improving the efficiency and controllability of skis.

BACKGROUND ART

As is known, one of the characteristics of the shape of skis is that the surface of the ski is curved, with a central region that is raised with respect to the ends so as to form an upward convexity.

During use, skis are subjected to stresses that tend to flatten the convexity due to the elasticity of the materials of which the skis are made.

This occurs particularly when negotiating curves and has negative consequences on ski efficiency and control.

In particular, the continuous change of the convexity of the skis alters the distance between the elements that form the ski bindings, the toe unit and the heel unit, considering that the boot is located at the center of gravity.

In Alpine competition skiing, the stresses to which the skis are subjected are very high and cause difficulties in control, unexpected losses of balance, the need for continuous attitude corrections, and the transmission of vibrations to the athlete's legs.

In order to reduce the above drawbacks, devices commonly termed pads have been devised and are currently in use; said devices are interposed between the skis and the bindings.

However, so far none of the available devices allows satisfactory direct control of the skis.

Among these devices, a first one comprises a metal lamina having a rear end stably fixed to the ski and a front end retained so that it slides parallel to said ski; a layer of elastic material is applied between the metal lamina and the ski, and the middle portion of the lamina, on which the bindings are fixed, is raised.

With this device, the distance between the toe unit and the heel unit of the binding is kept constant, but its position with respect to the center of gravity of the ski becomes variable.

For example, during extension the toe unit, and thus the boot, shift forward with a consequent change in positional relationship between the skier and the ski (the center of gravity is shifted).

Another drawback in the use of this device is due to the fact that the mobility of its front part worsens steerability and controllability of the ski, which is mainly maneuvered with its front part, with consequent inaccuracy in setting trajectories, the need for continuous corrections, and a consequent limitation of speed.

In a second type of device, similar to the preceding one, the toe unit of the binding is fixed to two supports that are rigidly coupled to the ski, and the heel unit is applied to a metal lamina that is longitudinally slideable.

This improves the setup of the curve trajectory, but the fact that the heel unit is movable with respect to the ski and with respect to the toe unit causes an inconstant positional relationship between the boot and the binding and therefore between the boot and the ski, making ski control inaccurate.

A third type of device has a metal lamina which is shaped so as to have two raised regions at the regions where the heel unit and the toe unit are fixed.

The lamina is fixed to the ski both at the front and at the rear, and a layer of elastic material is placed in the regions where said lamina is raised.

This device has the only positive effect of damping vibrations that are transmitted from the ski to the athlete's leg.

EP-A-510 308 has already proposed to provide a device comprising at least two elongated shaped plate-like elements, each element having one end provided with means for it being fixed to a ski and another end provided with retention means which allow said other end to slide longitudinally with respect to said ski, a toe unit and a heel unit being fixed proximately to one of said ends. However in such known device, such fixing of said units occurs by securing them directly to the ski itself. This has the disadvantage that when the ski is flexed, the units tend to either diminish or to increase the distance between themselves, and thus the gravity center on the ski may be displaced. As a whole, the device of EP-A-510 308 dampens vibrations, but does not prevent them from occurring.

DISCLOSURE OF THE INVENTION

The aim of the present invention is to provide a new device for improving the efficiency and controllability of skis which eliminates or substantially reduces the drawbacks described above in known types.

A consequent primary object is to provide a device that improves the efficiency and controllability of skis, keeping the position of the boot unchanged with respect to the ski, maintaining a center-of-gravity position for the skier, and preventing vibrations from occurring.

Another important object is to provide a device that allows to control and adjust the longitudinal movement of the ski.

Another important object is to provide a device that allows to achieve faster skiing.

Another object is to provide a device that can also be configured so that it can absorb the stresses induced in a substantially vertical direction on the ski.

Another object is to improve ski control in any situation, especially when negotiating curves.

Another object is to provide a device that can be manufactured with conventional equipment and facilities.

This aim, these objects and others which will become apparent hereinafter are achieved by a device for improving the efficiency and controllability of skis, comprising a device for improving the efficiency and controllability of skis, comprising, at least two elongated shaped plate-like elements, each element having one end provided with fixing means for fixing to a ski and another end provided with retention means which allow said other end to slide longitudinally with respect to said ski; damping elements arranged between said plate-like elements and said ski, a toe unit and heel unit of a ski binding being fixed proximately to one of said end.

BRIEF DESCRIPTION OF THE DRAWINGS

Further characteristics and advantages of the invention will become apparent from the following detailed description of an embodiment thereof, illustrated only by way of non-limitative example in the accompanying drawings, wherein.

WAYS OF CARRYING OUT THE INVENTION

Figure 1:
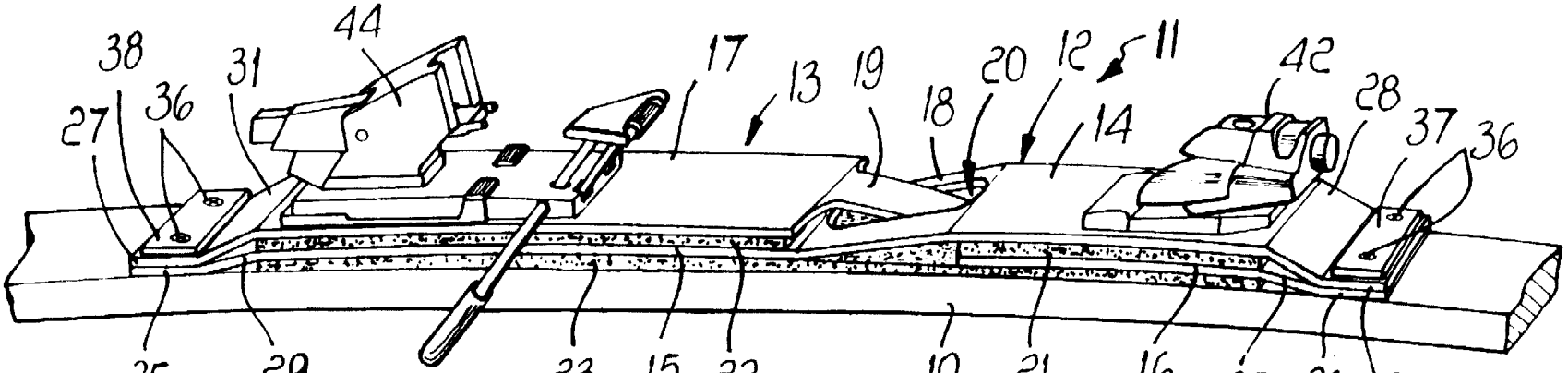
FIG. 1 is a perspective view of the device applied to a ski.
Figure 2:
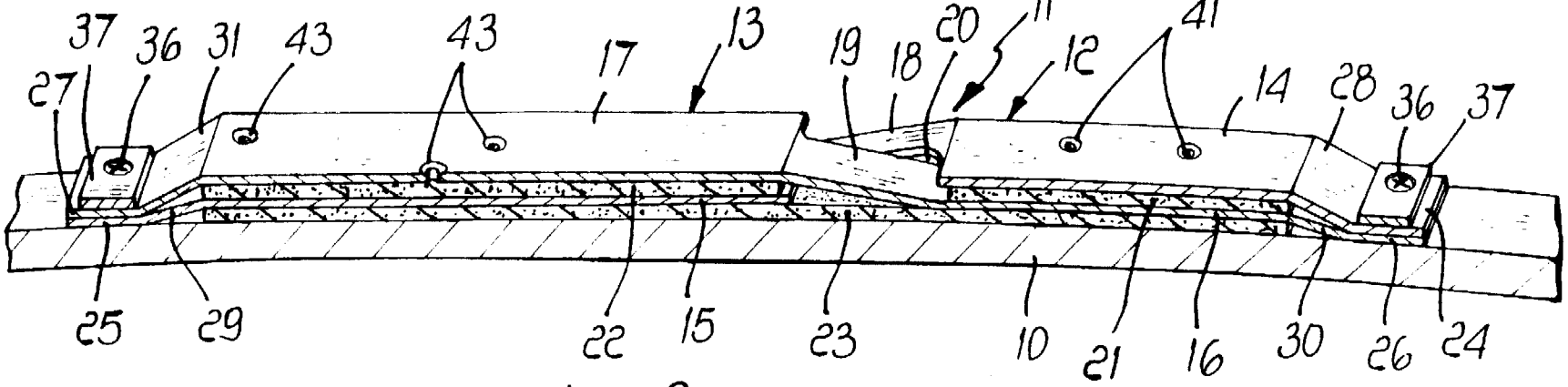
FIG. 2 is a longitudinally sectional perspective view of the device.
Figure 3:
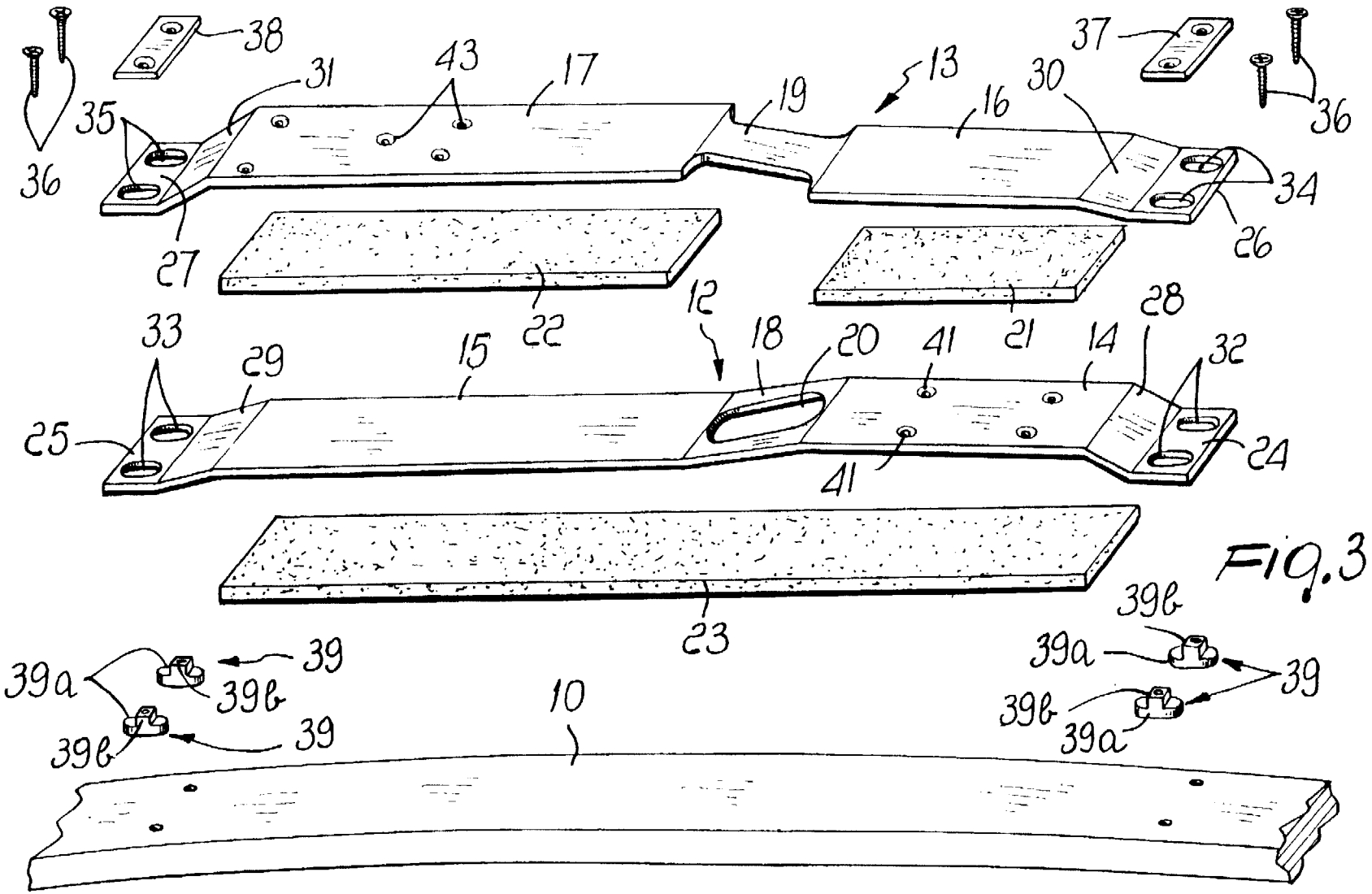
FIG. 3 is an exploded view of the device.
Figure 4:
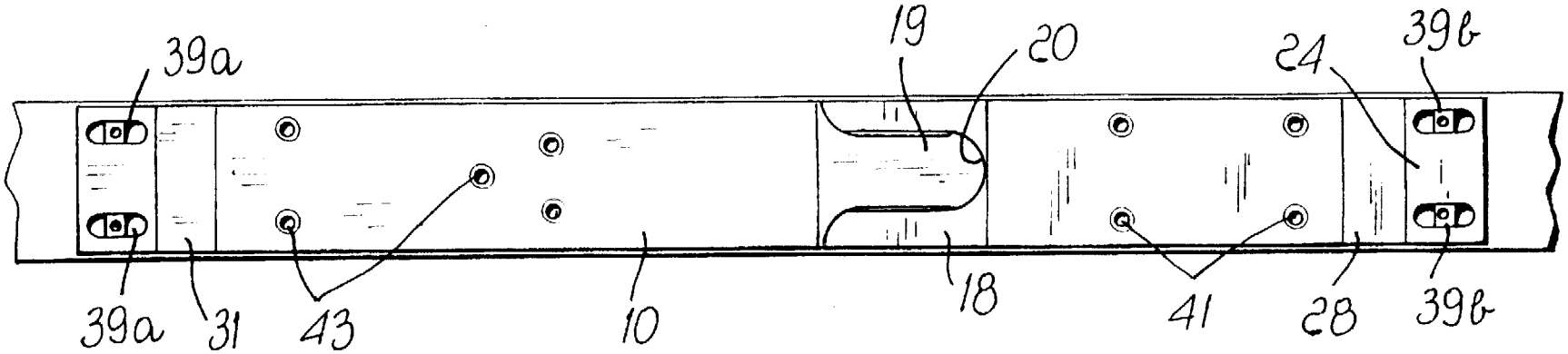
FIG. 4 is a top plan view of the device.
Figure 5:
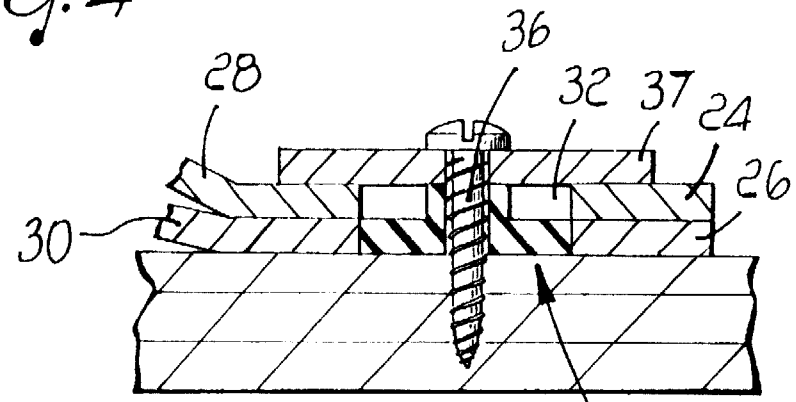
FIGS. 5 and 6 are longitudinal sectional views of each end of the device.
Figure 7:
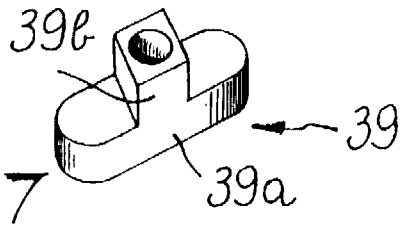
FIG. 7 is a perspective view of an element included in the device.
Figure 6:
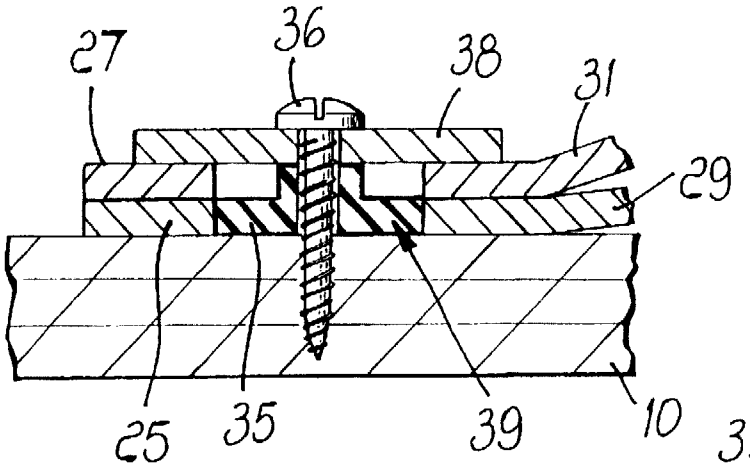

With reference to the above figures, a device according to the invention, conveniently applied at the upper center-of-gravity region of a ski 10, is generally designated by the reference numeral 11 and comprises two elongated shaped metal laminae, respectively a first lamina 12 and a second lamina 13, which are appropriately made of aluminum alloy or equivalent materials.

The first lamina 12 and the second lamina 13 extend upwardly from their ends, on inclined planes, so that they are raised with respect to the surface for resting on the ski 10; each lamina has two portions, respectively a first lamina front portion 14, a first lamina rear portion 15, a second lamina front portion 16 and a second lamina rear portion 17, that lie at mutually different levels.

The first lamina rear portion 15 is located at a different level with respect to the first lamina front portion 14, and is connected thereto by a first lamina inclined region 18. Similarly, the second lamina rear portion 17 is located at a different level with respect to the second lamina front portion 16, and is connected thereto by a second lamina inclined region 19.

At the first lamina inclined region 18, the first lamina 12 has a wide longitudinal slotted hole 20 which is traversed by the second lamina inclined region 19, which is appropriately tapered with respect to the rest of said second lamina 13.

In this manner, the two laminae 12 and 13 mutually intersect at the inclined regions 18,19 and the various flat portions 14, 15, 16, 17 overlap.

In particular, with reference to the figures, the first lamina front portion 14 overlaps the second lamina front portion 16 and the second lamina rear portion 17 overlaps the first lamina rear portion 15.

The first lamina front portion 14 and the second lamina rear portion 17 lie substantially at the same level, and the same is true for the first lamina rear portion 15 and the second lamina front portion 16.

Layers, respectively a front upper layer 21, a rear upper layer 22, and a lower layer 23, made of elastic material, or equivalent devices, can be conveniently interposed between the various overlapping portions 14, 15, 16, 17 and between said portions 14, 15, 16, 17 and the ski 10. In the illustrated example, the front upper layer 21 is interposed between the first lamina front portion 14 and the second lamina front portion 16; the rear upper layer 22 is interposed between the first lamina rear portion 15 and the second lamina rear portion 17; the lower layer 23 is interposed between the upper surface of the ski 10, and the lower surfaces of the first lamina rear portion 15 and the second lamina front portion 16.

The front end 24 and the rear end 25 of the first lamina 12, and the front end 26 and the rear end 27 of the second lamina 13, are also flat, mutually overlap, and are joined to the ski by means of inclined portions, designated by the reference numerals 28 and 29 for the first lamina 12 and by the reference numerals 30 and 31 for the second lamina 13.

Said ends 24, 25, 26, 27 each have longitudinal slotted holes, respectively 32, 33 for the first lamina 12 and 34, 35 for the second lamina 13, for fixing to the ski 10 by means of screws 36.

Plates 37 and 38 are arranged on the overlapping ends 24, 26 and 25, 27 respectively.

The screws 36 pass through the plates 37 and 38 and through shaped elements 39; each shaped element 39 has a portion **39*a*, which is shaped complementarily with respect to the profile of the slotted holes 32, 33, 34, and 35, and a parallelepipedal portion or narrowed portion 39*b*, which is arranged centrally with respect to the complementarily-shaped portion 39*a***.

The two portions **39*a* and 39*b* have substantially the same thickness as the laminae 12 and 13**.

When the corresponding screw 36 is fixed, the shaped element 39 blocks one lamina with its portion **39*a*, whereas its portion 39*b*** leaves the other lamina free to shift.

Each element 39 can be arranged so that its portion **39*a*** is at the top or at the bottom.

The device 11 is fixed to the ski 10 so that the front end 24 of the lamina 12 and the rear end 27 of the lamina 13 can slide freely, while the rear end 25 of the lamina 12 and the front end 26 of the lamina 13 are fixed.

Holes 41 for fixing the toe unit 42 of a ski binding are arranged on the raised front portion 14 of the first lamina 12, whereas holes 43 for fixing the heel unit 44 of the binding are arranged on the rear portion 17 of the second lamina 13.

The binding is conveniently arranged so that the boot is at the center of gravity of the ski.

As regards use, when negotiating curves the ski, which is curved so that it cambers upward, flattens and thus reduces its convexity.

The result of this is that the end of each lamina 12 and 13 that is fixed to the ski moves with respect to the fixed end of the other lamina, following the flattening action, whereas the free ends of said laminae slide longitudinally and compensate for it.

The same relative (center-of-gravity) position is thus maintained at all times between the boot and the ski, and thus the possibility to control said ski is always optimum.

If the device has elastic layers arranged between the laminae, these layers furthermore absorb the vertical stresses applied to the ski by the unevenness of the snow-covered surface or by changes in the structural characteristics thereof.

In practice it has been observed that the intended aim and objects of the present invention have been achieved.

The invention thus conceived is susceptible to numerous modifications and variations, all of which are within the scope of the inventive concept.

Thus, for example, the crossing of its laminae can be provided even without intersection but for example between two tapered portions thereof arranged side by side.

As an alternative, it is possible to provide laminae that do not mutually cross but nonetheless are individually provided with a first fixed end and a second end that is slideable along the ski.

The elements of the bindings may also be fixed in the vicinity of the fixed ends of the laminae.

It is also possible to make the laminae mutually interact by connecting them, for example, with a hydraulic actuator that changes their possibilities of moving with respect to each other according to the operating conditions, in order to adapt the response of the ski for example to changed conditions of the snow-covered surface (frozen, powdery, compact, etc.).

This change in movement can provide for a variation in the seepage rate between two chambers with hydraulic fluid due to the variation of a port that allows flow between them.

Said hydraulic actuator can be controlled by sensors which are located in various regions of the ski and are sensitive to the stresses applied thereto.

Finally, it should be noted that in possible configurations the device according to the invention can be integrated in the structure of the ski and/or of the bindings.

All the details may furthermore be replaced with other technically equivalent elements.

In practice, the materials employed, so long as they are compatible with the contingent use, as well as the dimensions, may be any according to the requirements.

What is claimed is:

1. A device for improving the efficiency and controllability of a ski having fixed thereon, at an upper region where the center-of gravity thereof lays, a ski binding including a toe unit and a heel unit, the device comprising at least two elongated plate shaped elements, each of said plate shaped elements having a first fixed end provided with means for fixing to the ski and a second slideable end provided with retention means for retention of said second end on the upper region of the ski while allowing, at the same time, said second end to slide longitudinally with respect to the ski, the toe unit and the heel unit being fixable each proximately to a respective one of said ends of the plate shaped elements for fixing therebetween a boot, and wherein said at least two plate shaped elements are shaped so as to be both positionable at said upper region with the slideable end of a first plate shaped element and the fixed end of a second plate shaped element arranged to the front and the fixed end of the first plate shaped element and the slidable end of the second plate shaped element arranged to the rear of said upper region, said toe unit and said heel unit being fixed each at a respective one of said longitudinally slideable ends of said plate shaped elements so as to avoid a fixed connection with said ski.

2. Device according to claim 1, wherein said at least two plate shaped elements are independent.

3. Device according to claim 1, wherein said at least two plate shaped elements at least partially overlap each other and mutually cross.

4. Device according to claim 1, wherein said at least two plate shaped elements are arranged at least partially side by side.

5. Device according to claim 1, wherein said at least two plate shaped elements are connected by control means for controlling mutual movements thereof.

6. Device according to claim 5, wherein said control means are constituted by at least one hydraulic actuator controlled by sensors located on the ski.

7. Device according to claim 1, wherein the bindings are mounted on regions of said plate shaped elements which are raised with respect to surfaces thereof for resting on the ski.

8. Device according to claim 1, comprising damping elements, said at least two plate shaped elements being combined with said damping elements which are interposable between various overlapping portions of the plate shaped elements and between said overlapping portions of the plate shaped elements and the ski.

9. Device according to claim 8, wherein said at least two plate shaped elements are combined with said damping elements arranged between said plate shaped elements, with at least two of said damping elements at least partially overlapping each other.

10. Device according to claim 9, wherein said damping elements are constituted by layers of elastic materials.

11. Device according to claim 7, wherein said plate shaped elements comprise each a lamina having ends, and portions which are raised with respect to surfaces thereof for resting on the ski, each of said plate shaped elements having two of said portions arranged at mutually different levels, the raised portions being connected by inclined regions, one of said plate shaped element having, in the inclined region thereof, a large longitudinal slotted hole, said hole being crossed by the corresponding inclined portion of the other plate shaped element which is therefor appropriately tapered.

12. Device according to claim 1, comprising two plate shaped elements having tapered portions, said plate shaped elements mutually intersecting at said tapered portions thereof which are arranged side by side.

13. Device according to claim 1, further comprising screws and fixing shaped elements, said plate shaped elements being flat with both said fixed and slideable ends thereof having longitudinal slotted holes for fixing to the ski, said screws passing through said holes of the plate shaped elements and through said fixing elements, each of said fixing elements having an enlarged portion that is shaped complementarily with respect to the profile of the slotted holes and a parallelepipedal portion that lies centrally with respect to the enlarged portion, with said enlarged portion being substantially as thick as said plate shaped elements, and said fixing shaped elements each locking a first one of said plate shaped elements, upon fixing to the ski, with said enlarged portion thereof, while leaving a second one of said plate shaped elements free to slide with respect to the ski.

14. Device according to claim 1, wherein said plate shaped elements have holes for fixing the toe unit and the heel unit of the ski binding.

15. The device according to claim 1 being integrated in any of the structure of the ski and of the binding.

16. In combination a device for improving the efficiency and controllability of a ski and a ski binding including a toe unit and a heel unit positionable respectively to a front and a rear part of an upper region of the ski including the center-of-gravity thereof, the device comprising at least two elongated plate shaped elements, each of said plate shaped elements having a first fixed end provided with means for fixing to the ski, and a second slideable end provided with retention means which allow said second end to slide longitudinally with respect to said ski, said at least two plate shaped elements being both mountable, at said upper region of the ski, with the second slideable end of a first said plate shaped element and the first fixed end of a second said plate shaped element being arranged at said front part and with the first fixed end of the first said plate shaped element and the second slidable end of said second plate shaped element being arranged to said rear part of said upper region of the ski, said toe unit and said heel unit of the ski binding being fixable at the second slideable end of the first said plate shaped element and, respectively, at the second slideable end of said second plate shaped element, so as to avoid any fixed connection with the ski.

17. The combination of claim 16, wherein the device comprises screws and fixing shaped elements, said plate shaped elements being flat with both said fixed and slideable ends thereof having longitudinal slotted holes for fixing to the ski, said screws passing through said holes of the plate shaped elements and through said fixing elements, each of said fixing elements having an enlarged portion that is shaped complementarily with respect to the profile of the slotted holes and a parallelepipedal portion that lies centrally with respect to the enlarged portion, with said enlarged portion being substantially as thick as said plate shaped elements, and said fixing shaped elements each locking a first one of said plate shaped elements, upon fixing to the ski, with said enlarged portion thereof, while leaving a second one of said plate shaped elements free to slide with respect to the ski.

18. The combination of claim 16, wherein the device comprises damping elements, said at least two plate shaped elements being combined with said damping elements which are interposable between various overlapping portions of the plate shaped elements and between said overlapping portions of the plate shaped elements and the ski.

19. The combination of claim 18, wherein said at least two plate shaped elements are combined with said damping elements arranged between said plate shaped elements, with at least two of said damping elements at least partially overlapping each other.

20. In combination a device for improving the efficiency and controllability of a ski, a ski, and a ski binding including a toe unit and a heel unit positionable respectively to a front and a rear part of an upper region of the ski, the device comprising at least two elongated plate shaped elements, each of said plate shaped elements having a first fixed end provided with means for fixing to the ski, and a second slideable end provided with retention means which allow said second end to slide longitudinally with respect to said ski, said at least two plate shaped elements being both mounted, at said upper region of the ski, with the second slideable end of a first said plate shaped element and the first fixed end of a second said plate shaped element being arranged at said front part and with the first fixed end of the first said plate shaped element and the second slidable end of said second plate shaped element being arranged to said rear part of said upper region of the ski, said toe unit and said heel unit of the ski binding being fixed at the second slideable end of the first said plate shaped element and, respectively, at the second slideable end of said second plate shaped element, by avoiding any fixed connection with the ski, so that upon flexing of the ski, a relative movement between the fixed end of the first plate shaped element and the fixed end of the second plate shaped element occurs, whereas the free ends of said first and second plate shaped elements, with said toe and heel unit fixed thereon, are allowed to slide accordingly and compensate for this movement.

* * * * *